US011097315B1

(12) United States Patent
Klein

(10) Patent No.: US 11,097,315 B1
(45) Date of Patent: Aug. 24, 2021

(54) CANNABIS PARTICULATE SEPARATOR

(71) Applicant: Justin Hyland Klein, Bozeman, MT (US)

(72) Inventor: Justin Hyland Klein, Bozeman, MT (US)

( * ) Notice: Subject to any disclaimer, the term of this patent is extended or adjusted under 35 U.S.C. 154(b) by 59 days.

(21) Appl. No.: 16/814,695

(22) Filed: Mar. 10, 2020

Related U.S. Application Data

(60) Provisional application No. 62/818,673, filed on Mar. 14, 2019.

(51) Int. Cl.
*B07B 1/28* (2006.01)
*B07B 13/04* (2006.01)
*B07B 1/46* (2006.01)

(52) U.S. Cl.
CPC ..... *B07B 13/04* (2013.01); *B07B 1/28* (2013.01); *B07B 1/4609* (2013.01); *B07B 2220/00* (2013.01)

(58) Field of Classification Search
CPC .. B07B 13/04; B07B 1/00; B07B 1/28; B07B 1/4609; B07B 2220/00
USPC ..... 209/417, 420, 509
See application file for complete search history.

(56) References Cited

U.S. PATENT DOCUMENTS 1,142,017 A * 6/1915 Brown ..... B65D 5/48024 229/120.32
5,190,158 A * 3/1993 Remias ..... B03B 7/00 209/44
5,368,170 A * 11/1994 Leis ..... A47J 43/22 209/274
8,646,614 B2 * 2/2014 Peterson ..... B03B 5/02 209/235
2005/0112427 A1 * 5/2005 Bailey ..... H01M 4/00 429/122
2016/0108555 A1 * 4/2016 Rosado ..... B07B 1/06 209/409
2016/0158803 A1 * 6/2016 Rosado ..... B07B 1/02 209/373

* cited by examiner

*Primary Examiner* — Terrell H Matthews
(74) *Attorney, Agent, or Firm* — Polson Intellectual Property Law, PC; Christopher Sylvain; Margaret Polson

(57) ABSTRACT

A cannabis particulate separator and a method for separating cannabis by size using such a cannabis particulate separator. The cannabis particulate separator includes a body, supporting projections, apertures, and flaps. The body has a top surface and a bottom surface. The apertures extend through the body between the top and bottom surfaces. The flaps are integrally disposed on the bottom surface. Each flap is connected to the bottom surface adjacent to one of the apertures. The flaps extend away from the bottom surface at an angle. The supporting projections extend away from the body and are configured to bend inward toward the bottom surface.

20 Claims, 9 Drawing Sheets

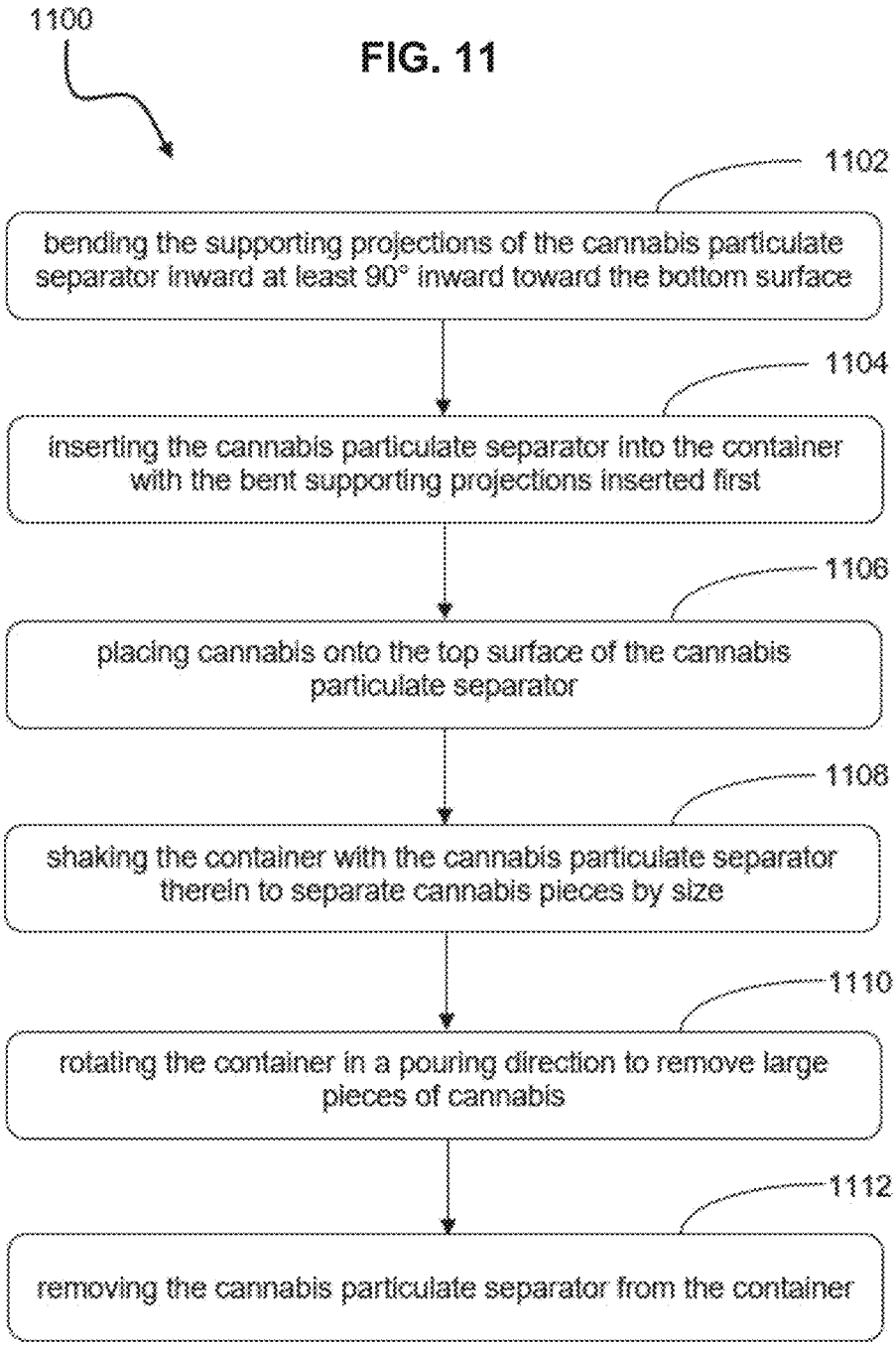
1100
FIG. 11
1102
bending the supporting projections of the cannabis particulate separator inward at least 90° inward toward the bottom surface
1104
inserting the cannabis particulate separator into the container with the bent supporting projections inserted first
1106
placing cannabis onto the top surface of the cannabis particulate separator
1108
shaking the container with the cannabis particulate separator therein to separate cannabis pieces by size
1110
rotating the container in a pouring direction to remove large pieces of cannabis
1112
removing the cannabis particulate separator from the container

CANNABIS PARTICULATE SEPARATOR

BACKGROUND

Trimmed cannabis flowers or buds, which are colloquially referred to as "nuggets", are generally packaged in containers (e.g. glass jars, plastic tubes or bottles, etc.) for storage, display and/or sale in the cannabis industry. Through the course of handling, smaller pieces may break off from larger pieces of cannabis buds, since cannabis is typically dried after harvesting and therefore susceptible to flaking from contact with other cannabis buds and the interior surfaces of the container. Such smaller pieces of cannabis which fall off are colloquially referred to as "shake". For example, shake may become dislodged from cannabis buds when a container is moved or set down, or when cannabis buds are shifted—as can occur during inspection or aromatic sampling. However, intact larger pieces of cannabis buds are often preferred by consumers in buying bulk cannabis, even though there may be no actual difference in quality between larger cannabis buds and shake derived therefrom. Therefore, cannabis industry members will sometimes separate larger pieces of cannabis from smaller pieces of cannabis to accommodate the market. Moreover, shake may be readily used for other products (e.g. edibles, pre-rolled cannabis cigarettes or "joints", and the like) without needing to use available stock of intact cannabis buds for this purpose. However, the process of separating such larger pieces of cannabis from such smaller pieces of cannabis can be inefficient and/or time-consuming.

The foregoing example of the related art and limitations related therewith are intended to be illustrative and not exclusive. Other limitations of the related art will become apparent to those of skill in the art upon a reading of the specification and a study of the drawings.

SUMMARY

The present disclosure relates to a cannabis particulate separator and a method for separating cannabis by size using such a cannabis particulate separator. The cannabis particulate separator comprises a body, supporting projections, a plurality of apertures, and a plurality of flaps. The body has a top surface and a bottom surface. The supporting projections extend away from the body and are configured to bend inward toward the bottom surface of the body. In some embodiments, the body may have a side surface extending between the top and bottom surfaces, and the supporting projections may be connected to the body along the side surface. The apertures extend through the body between the top surface and the bottom surface. The flaps are integrally disposed on the bottom surface of the body. Each flap is associated with one of the apertures and connected to the bottom surface of the body adjacent to its respective aperture. The flaps extend away from the bottom surface of the body at an angle relative to the bottom surface. The angle at which the flaps extend away from the bottom surface of the body may be between 60° and 70°, for example. The apertures are substantially equal in diameter or width. The diameter or width of each aperture is generally ≤the length of each flap in extending away from the bottom surface of the body, such that the flaps are configured to cover the apertures if pressed toward the bottom surface of the body.

In some embodiments, each supporting projection has a notch extending into the supporting projection adjacent to the bottom surface of the body. The notches are configured to allow the supporting projections to bend at least 90° inward toward the bottom surface of the body. Some embodiments may further comprise at least one support column integrally connected to and extending away from the bottom surface of the body. Some embodiments may comprise a gripping portion integrally connected to and projecting outward away from the top surface of the body, wherein the gripping portion is configured to be grasped by a user. Some embodiments may comprise at least one visual indicator on the top surface of the body, which indicates the direction of the flaps in extending away from the bottom surface of the body at the angle. For example, the visual indicator may comprise color, text, or a symbol. In some embodiments, the plurality of supporting projections may be four supporting projections equally spaced around the body.

The cannabis particulate separator may comprise a flexible or semi-flexible material, such as silicone for example. At least the attachments between the supporting projections and the body should include such material. In other embodiments, the entire separator is made from a flexible or semi-flexible material. For example, the cannabis particulate separator may be formed by injection-molding.

A method for separating cannabis particulates by size, using a cannabis particulate separator according to the present disclosure, may comprise the steps of bending the supporting projections of the separator at least 90° inward towards the bottom surface of the body of the separator; inserting the separator into a container such that the supporting projections are biased against an interior surface of the container by elastic forces, whereby the cannabis particular separator is held in place within the container by the elastic forces of the supporting projections and by frictional forces between the interior surface of the container and the supporting projections; placing cannabis onto the top surface of the body of the separator positioned within the container; shaking the container with the separator positioned therein to agitate the cannabis, such that smaller pieces of cannabis having a width or diameter less than the width or diameter of the apertures enter the apertures at the top surface of the body, fall through the apertures to exit the apertures at the bottom surface of the body, and fall into a lower portion of the container enclosed by the body of the cannabis particulate separator; rotating the container with the separator positioned therein in a pouring direction to remove larger pieces of cannabis having a width or diameter greater than the width or diameter of apertures on the top surface in an upper portion of the container from the container, whereby the angle at which the flaps extend away from the bottom surface of the body faces the pouring direction, such that the flaps prevent the smaller pieces of cannabis contained within the lower portion of the container from reentering the apertures from the bottom surface of the body and exiting with the larger pieces of cannabis; and removing the cannabis particulate separator from the container. The flaps may close over the apertures by the weight of the smaller pieces of cannabis when the container is rotated in the pouring direction to remove the larger pieces of cannabis. In embodiments of the cannabis particulate separator having one or more support columns, the cannabis particulate separator is inserted into the container until the support column contacts a bottom surface of the container during the step of inserting the separator into the container. In embodiments of the cannabis particulate separator having a gripping portion, the cannabis separator may be removed by a user grasping the gripping portion and pulling the separator out from the container during the step of removing the separator from the container.

The following embodiments and aspects thereof are described and depicted in conjunction with systems, tool and methods which are meant to be illustrative, not limiting in scope. In various embodiments, one or more of the above described problems have been reduced or eliminated, while other embodiments are directed to other improvements.

BRIEF DESCRIPTION OF THE DRAWINGS

The present disclosure is described hereinafter based on illustrative embodiments with reference to the following figures:

FIG. 11 shows a process flowchart of an embodiment method of using a cannabis particulate separator according to the present disclosure;

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

The following descriptions with respect to a particular embodiment and the elements thereof applies equally to other embodiments and the like elements thereof, unless expressly indicated.

Figure 1:
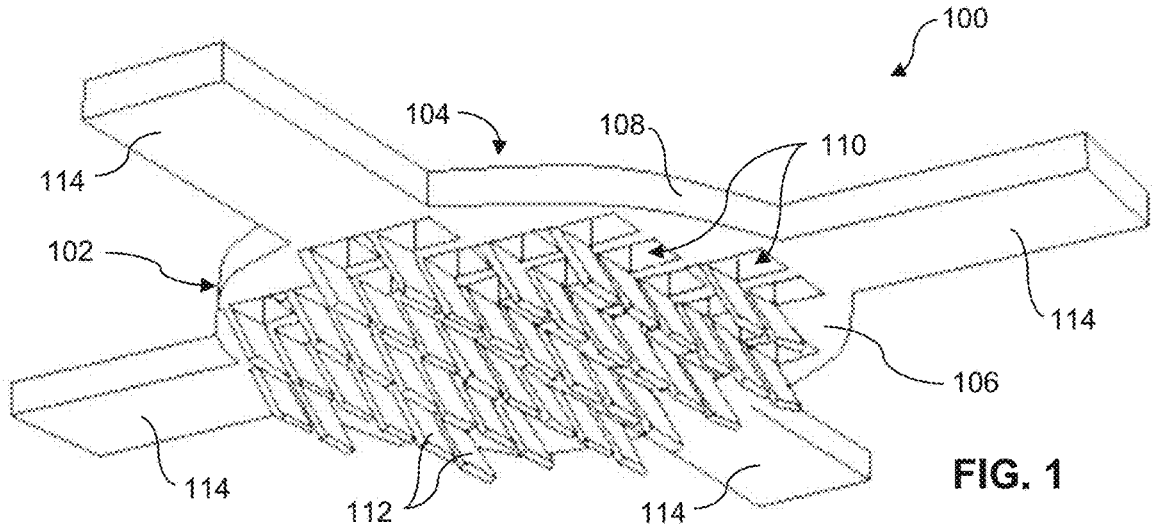
FIG. 1 shows a bottom perspective view of an embodiment of a cannabis particulate separator according to the present disclosure.

FIG. 1 illustrates an embodiment of a cannabis particulate separator 100 according to the present disclosure. The separator 100 comprises a body 102 having a top surface 104, a bottom surface 106, and a side surface 108 extending between the top surface 104 and the bottom surface 106. While not visible in FIG. 1, the top surface 104 forms the opposite surface of the body 102 relative to the bottom surface 106, and as such, the location of the top surface 104 is generally indicated by an arrowed line in FIG. 1. The separator 100 further comprises a plurality of apertures 110 and flaps 112. The apertures 110 extend through the body 102 between the top surface 104 and the bottom surface 106. The apertures 110 are equally sized in the depicted embodiment. The diameter of the apertures 110 is selected according to the desired particulate size selectivity of the separator 100. The flaps 112 are integrally disposed on the bottom surface 106 of the body 102 and extend away from the bottom surface 106 of the body 102. Each flap 112 is positioned adjacent to one of the apertures 110 on the bottom surface 106 of the body 102. The flaps 112 are inclined relative to the bottom surface 106 of the body 102 at an angle, and share the same default orientation as each other in their extension away from the body 102. In this way, each flap 112 extends toward the longitudinal axis of its respective aperture 110 as the flap 112 also extends away from the body 102. The length of each flap 112 in extending away from the body 102 is at least large as the diameter or width of its corresponding aperture 110. The separator 100 further comprises a plurality of supporting projections 114 which extend away from the body 102. In the depicted embodiment, the supporting projections 114 are formed along the side surface 108 and connect to the top surface 104 and the bottom surface 106, although other embodiments may include different configurations. Although the depicted embodiment has four supporting projections 114 equally spaced around the body 102, other embodiments may have a different number and/or structural arrangement of supporting projections. The supporting projections 114 are configured to bend inward towards the bottom surface 106 of the separator 100. Therefore, at least the attachment of the supporting projections 114 to the body 102 should be formed of a flexible or semi-flexible material (see also FIGS. 8-9). Likewise, at least the attachment of the flaps 112 to the body 102 should be formed of a flexible or semi-flexible material (see also FIGS. 10A-10C). As used herein, flexibility refers to the ability of the material to deform in response to a force (e.g. change shape and/or spatial orientation) and restore itself to its original configuration once the force is removed. In some embodiments, the entire cannabis particulate separator may be formed from a flexible or semi-flexible material. This may be advantageous in embodiments using an injection-molded construction, for example, wherein a single material or material composition/mixture is used. In addition to mechanical requirements, it may also be advantageous to select material in view of other application considerations, such as resistance to biological growth (cannabis is susceptible to mold) and/or good adhesion to container material. For example, silicone may be used to make the cannabis particulate separator. Silicone has sufficient flexibility properties, is resistant to biological growth, and has good adhesion to glass (which is a common container material in the cannabis industry). Of course, other suitable materials or material compositions/mixtures may also be used.

Figure 2:
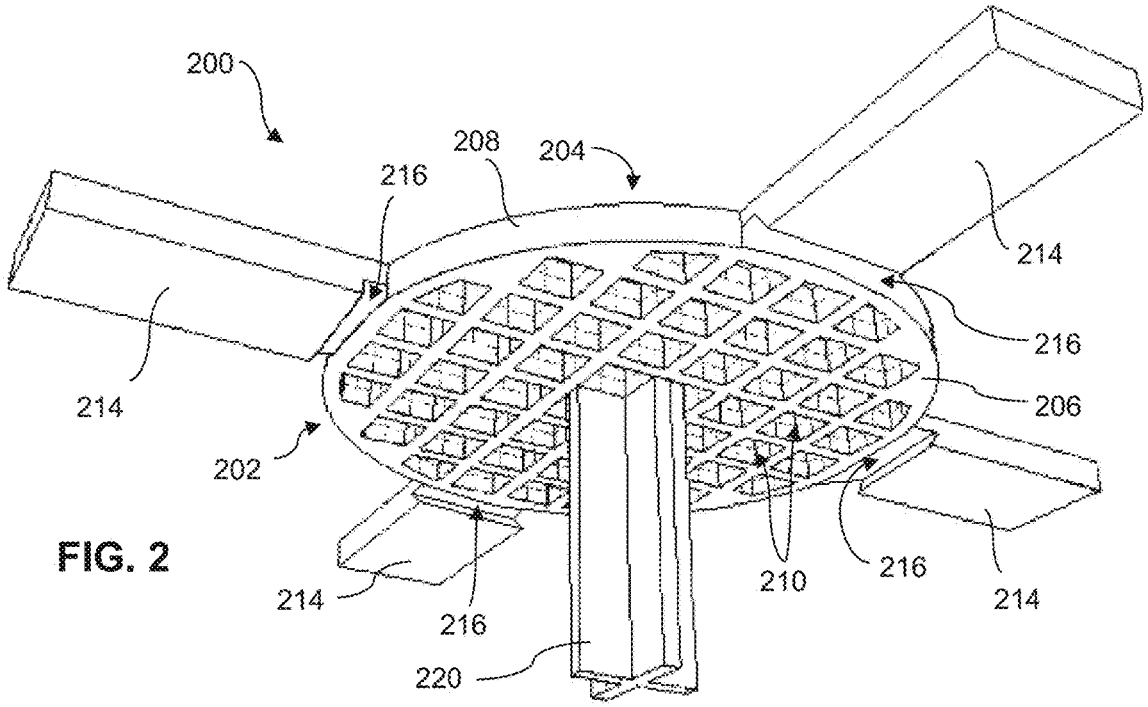
FIG. 2 shows a bottom perspective view of another embodiment of a cannabis particulate separator according to the present disclosure having a support column, with the flaps omitted for clarity.

FIG. 2 illustrates another embodiment of a cannabis particulate separator 200 further comprising at least one support column 220. Although separator 200 includes flaps as described above with respect to the embodiment of FIG. 1, the flaps have been omitted here for purposes of clarity in showing the support column 220. The preceding description in reference to the elements of the separator 100 also applies to like elements of the separator 200. The support column 212 is integrally connected to and extends away from the bottom surface 208 of the separator 200. The support column 220 provides additional support to the body 202 of the separator 200 to prevent the body 202 from drooping in the direction of the bottom surface 206 when weight is placed on the top surface 204. For example, one or more support columns may be desirable where the horizontal extent of the separator is large (e.g. the top/bottom surfaces have large surface areas), the vertical extent of the separator body is small (e.g. the side surface is relatively thin), the material used for the body or supporting projections is not particularly strong, and/or a large amount of cannabis is to be applied at once. The support column 220 is configured to contact a bottom surface of a container when the separator 200 is inserted into such container. Therefore, the length of the support column 220 in extending away from the body 202 may be equal or substantially equal (e.g. ±10%) to the length of the supporting projections 214 in extending away from the body 202. It should be appreciated that other embodiments may have a different number and/or spatial arrangement of support column(s). As seen in FIG. 2, the separator 200 further comprises supporting projection notches 216. Each notch 216 extends into its supporting projection 214 adjacent to the supporting projection's connection to the bottom surface 208 of the body 202. The notches 216 are configured to allow the supporting projections 214 to bend at least 90° inward toward the bottom surface 206 of the body 200.

Figure 3:
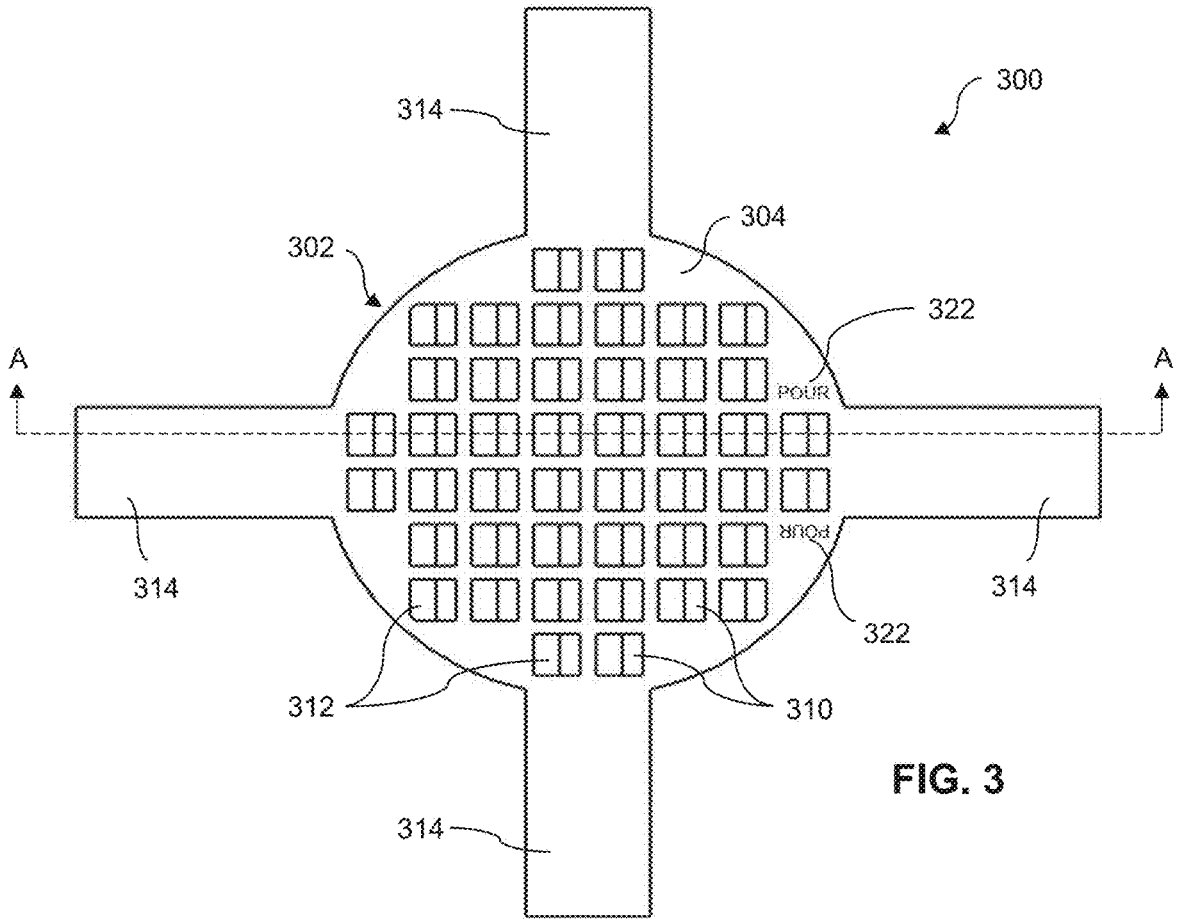
FIG. 3 shows a top view of another embodiment of a cannabis particulate separator according to the present disclosure.

FIG. 3 illustrates a top view of another embodiment of a cannabis particulate separator 300 according to the present disclosure. The preceding description in reference to the elements of the separators 100, 200 also applies to like elements of the separator 300. The top surface 304 of the body 302 of the separator 300 is visible in FIG. 3. The top surface 304 comprises at least one visual indicator 322 disposed thereon. The visual indicator 322 may include color, text, and/or a symbol (e.g. shapes, arrows, etc.). In the depicted embodiment, two visual indicators 322 are provided by the text "POUR" on the top surface 304 of the body 302. The visual indicators 322 indicate the horizontal direction of the flaps 312 in extending away from the bottom surface 306 of the body 302 at an angle. In other words, the one or more visual indicators 322 are located on the side of the top surface 304 corresponding to the sides of the apertures 310 opposite where the flaps 312 attach to the bottom surface 306 of the body 302. In still other words, the one or more visual indicators 322 indicate a container pouring direction as described in more detail below with respect to FIGS. 9 and 10A-10C.

Figure 4:
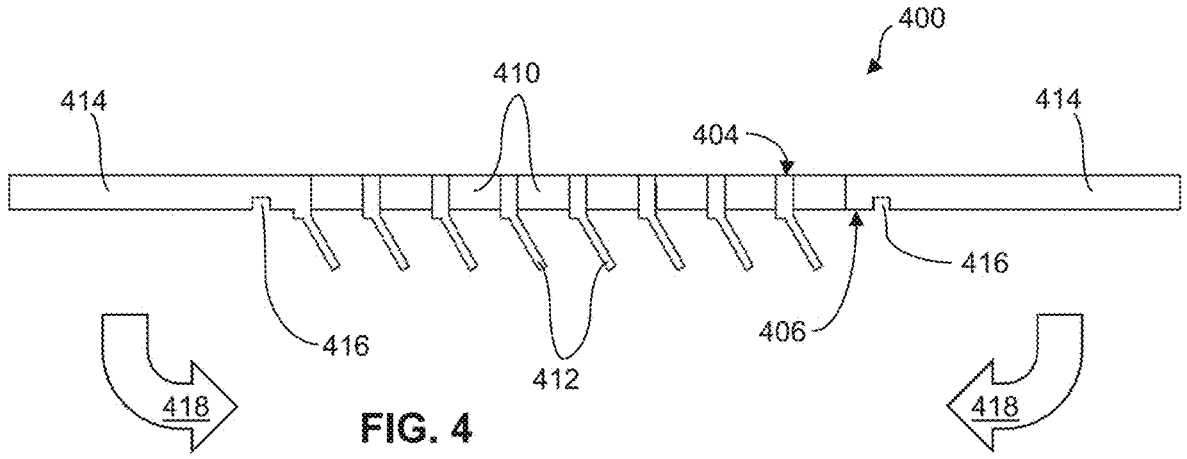
FIG. 4 shows a sectional view of the cannabis particulate separator of FIG. 3, taken along line A-A of FIG. 3.
Figure 5:
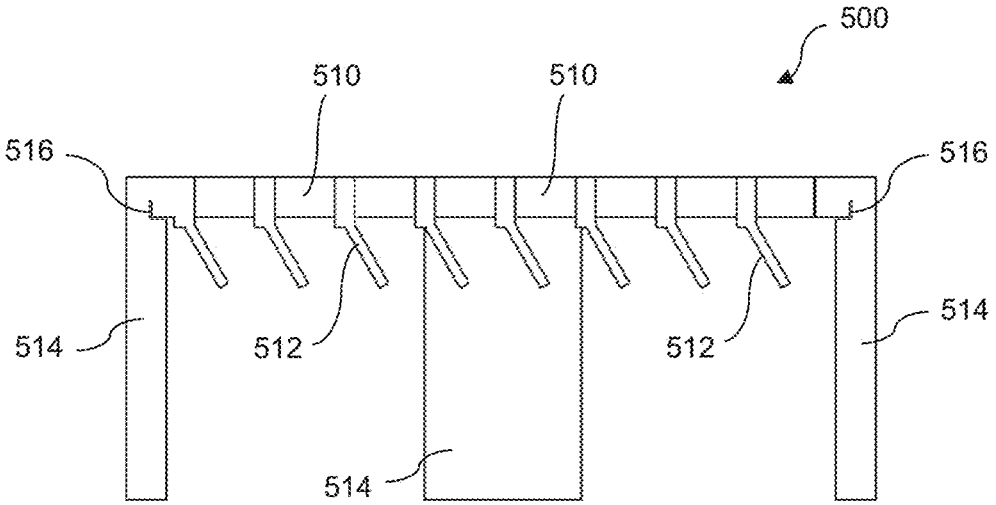
FIG. 5 shows the cannabis particulate separator of FIG. 4 with the supporting projections bent inward toward the bottom surface of the cannabis particulate separator.
Figure 6:
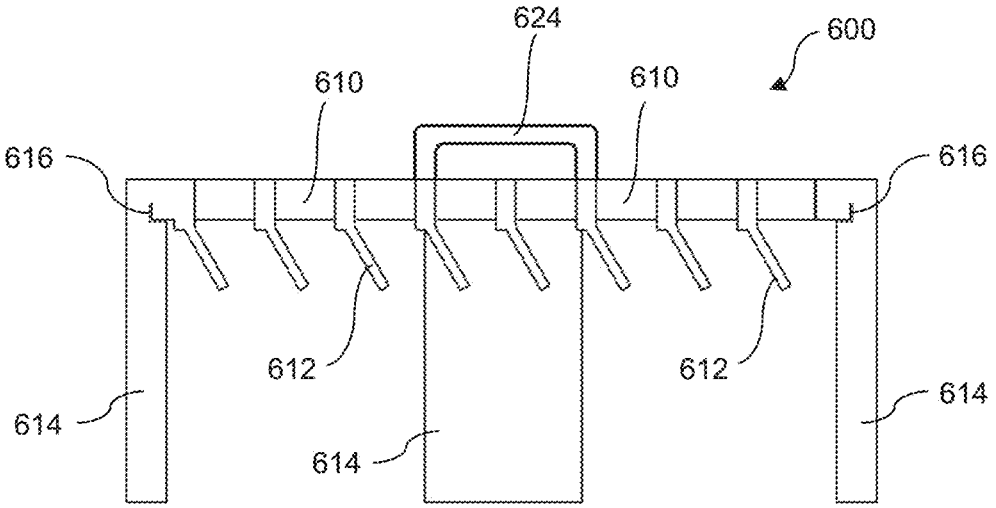
FIG. 6 shows the cannabis particulate separator of FIG. 5 in another embodiment having a gripping portion.

The supporting projection notches 416 of the cannabis particulate separator 400 are further visible in FIG. 4. The supporting projection notches 416 are configured to allow their respective supporting projection to bend or fold inward at least 90° toward the bottom surface 406 of the body 402. A folding direction 418 for each visible supporting projection 414 is also indicated here. In FIG. 5, the supporting projections 514 of the separator 500 have been folded 90° inward toward the bottom surface 506 of the body 502 in accordance with the folding directions 418 of FIG. 4. In so doing, the notches 616 have been collapsed between the body 602 and the supporting projections 614. Another one of supporting projections 514 is now visible in the center after folding, which was previously aligned in the plane of the body 402 and therefore not visible in FIG. 4. In the embodiment of FIG. 6, the cannabis particulate separator 600 further comprises a gripping portion 624 which is integrally connected to and extends away from the top surface 604 of the body 602. The gripping portion 624 is configured to be grasped by a user in removing or pulling out the cannabis particulate separator 600 from a container. Although the gripping portion 624 is depicted as a generally U-shaped projection in the illustrated embodiment, other embodiments may have different structural configurations as well as different positional locations along the top surface of the body.

Figure 7:
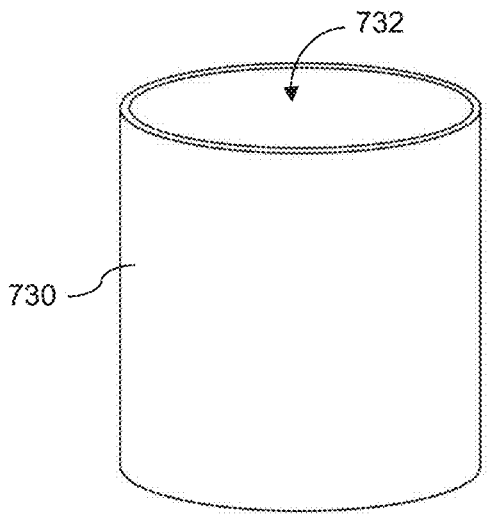
FIG. 7 shows a perspective view of a possible example container used with the cannabis particulate separator and method according to the present disclosure.
Figure 8:
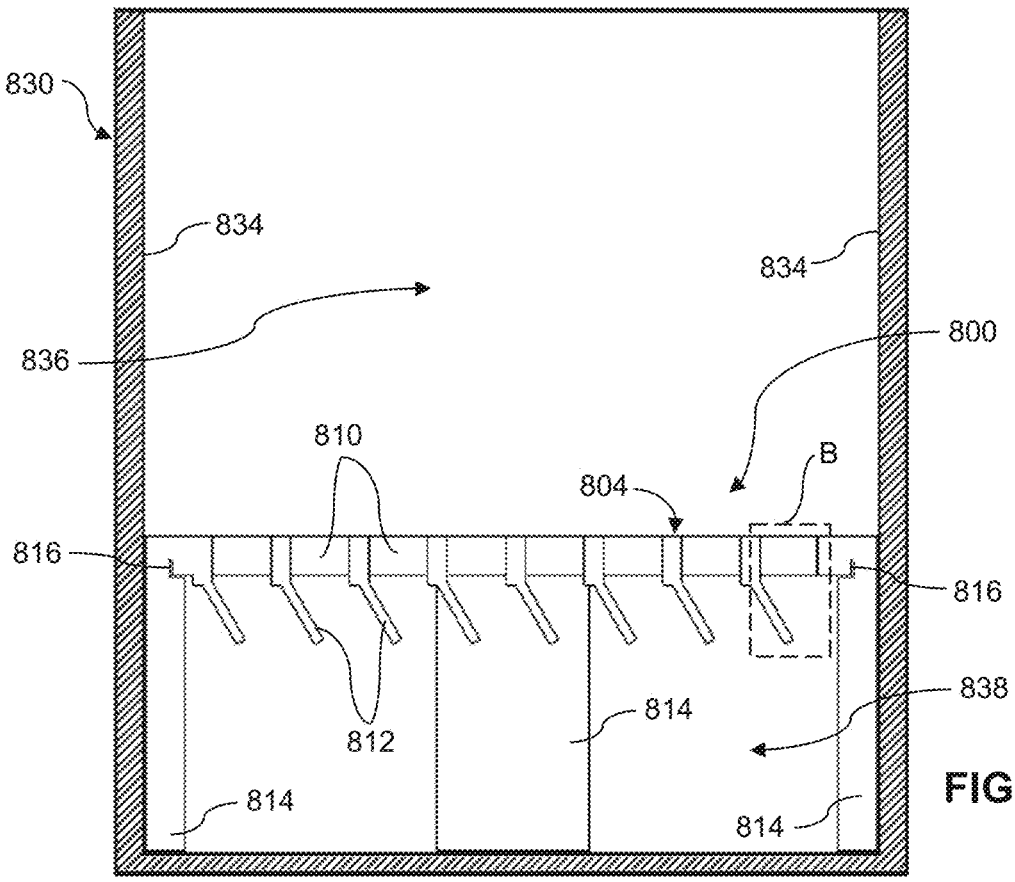
FIG. 8 shows the cannabis particulate separator of FIG. 5 inserted into the container of FIG. 7, from the sectional view of FIG. 5.

FIG. 7 depicts a possible example of a container 700 for use with a cannabis particulate separator according to the present disclosure. The container 700 has an interior volume cross sectional area 732 which extends within the horizontal plane when the container 700 is placed upright on a horizontal surface. It should be appreciated that the shape and dimensions of the interior volume cross sectional area 732 corresponds to the shape and dimensions of the body of the cannabis particulate separator when the supporting projections are folded inward toward the bottom surface of the body. In other words, the interior volume cross sectional area 732 should be largely or completely filled by the cannabis particulate separator, as seen in FIG. 8 for example. If the cannabis particulate separator is sized too large relative to a given container, then the cannabis particulate separator may not be able to be inserted into the container, or if it can be inserted, the surfaces of the body may be warped and affect the functionality of the device. If the cannabis particulate separator is sized too small relative to a given container, then gaps formed between the edge of the top surface and the interior surface of the container may affect the desired separation size selectivity (e.g. if a gap is wider than the diameter of the apertures), and further, the supporting projections may not function to properly adhere to the interior surface of the container, such that the cannabis particulate separator is dislodged from the container when turned upside down. Therefore, the specific shape and dimensions of the cannabis particulate separator may be selected to fit the container dimensions of intended use, or vice versa. For example, 4-inch inner diameter (i.d.) mason jars with circular interior volume cross sectional areas are commonly used in the cannabis industry, and the cannabis particulate separator may be specifically sized to such applications by design. Or, for example, the cannabis particulate separator may be sized for use with rectangular plastic bins in processing large amounts of cannabis. As discussed above, one or more support columns can be incorporated into the cannabis particulate separator to accommodate large amounts of cannabis and/or large interior volume cross sectional areas of containers.

FIG. 8 illustrates cannabis particulate separator 800 positioned inside container 830. Supporting projections 814 are folded inward and separator 800 has been inserted into the container 830 until the base of the supporting projections contacts the bottom interior surface of container 830. Due to the elastic forces of the supporting projections 814 to return to their non-folded configurations, the supporting projections 814 are biased against the interior surface 834 of the container 830. Therefore, the separator 800 is held in place within the container 830 by the elastic forces of the supporting projections 814 as well as frictional forces between the interior surface 834 of the container 830. As discussed above, the material of the supporting projections 814 may be selected at least in part for good adhesion to the material of the container 830, such as silicone and glass for example, which further secures the separator 830 within the container 830. The body 802 of the separator 800 inserted into the container 830 divides the interior volume of the container 830 into an upper or top portion 836 and a lower or bottom portion 838. The upper portion 836 is bounded by the top surface 804 of the separator 800, while the lower portion 838 is bounded by the bottom surface 806 of the separator 800. As seen in FIG. 8, the separator 800 and the container 830 are sized together so that no gaps are formed between the outer edges of the separator 800 and the interior surface 834 of the container 830.

Figure 9:
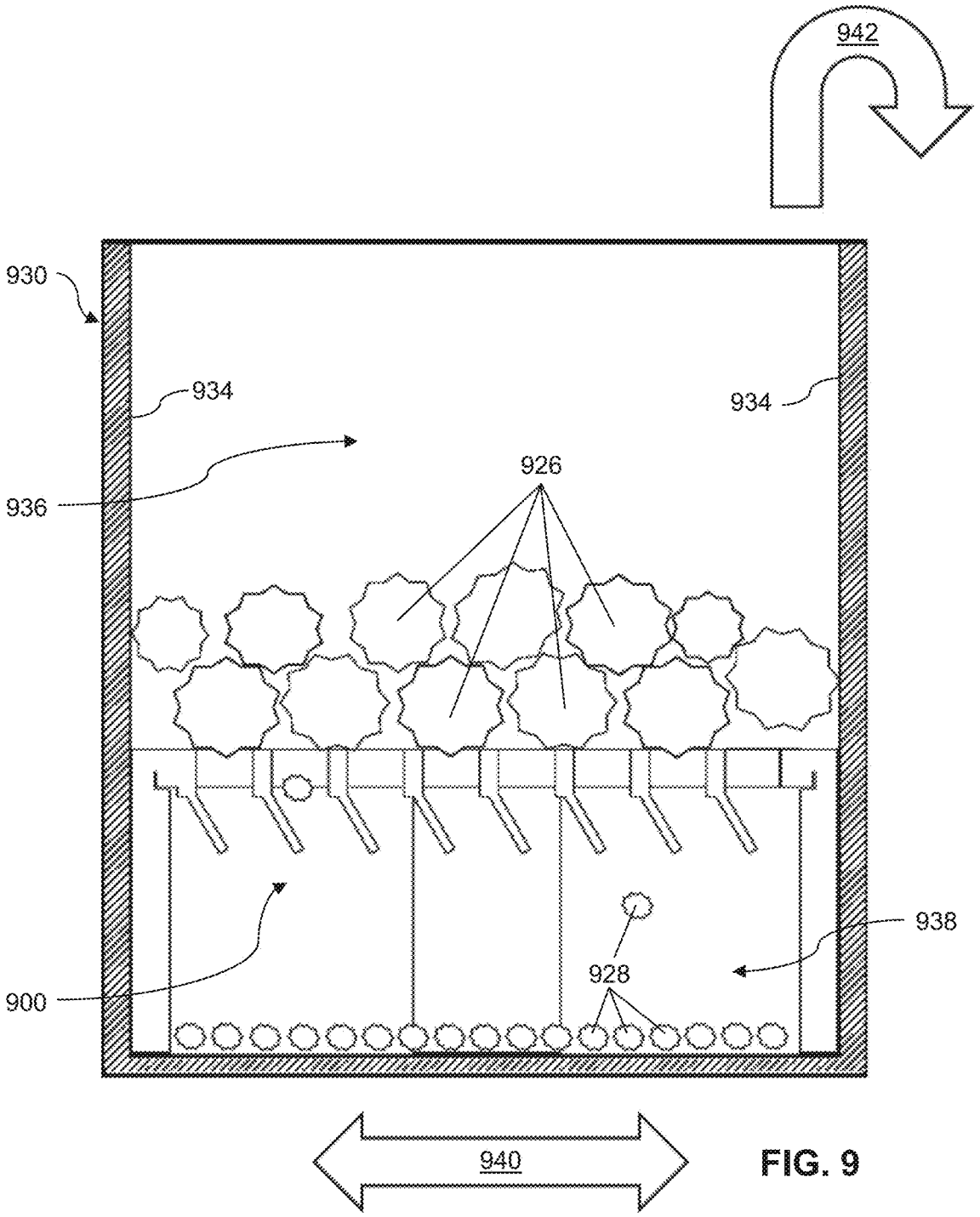
FIG. 9 shows the cannabis particulate separator and container of FIG. 8 with cannabis particulate material.

FIG. 9 illustrates cannabis particulate separator 900 positioned inside container 930 with cannabis particulates, including larger pieces of cannabis 926 and smaller pieces of cannabis 928. The larger pieces of cannabis 926 have a diameter or width larger than the diameter of the apertures 910. The smaller pieces of cannabis have a diameter or width smaller than the diameter of the apertures 910. In this way, the larger pieces of cannabis 926 are prevented from passing through the apertures 910 and remain on the top surface 904 of the separator 900 in the upper portion 936 of the container 930, while the smaller pieces of cannabis 928 pass through the apertures 910 and exit at the bottom surface 906 of the separator 900 to enter the bottom portion 938 of the container 930. A container shaking direction 940 is indicated by a block arrow in FIG. 9. In general terms, the container shaking direction corresponds to the displacement of the container 930 with the separator 900 positioned therein in horizontal or largely horizontal planes. The container 900 is shaken in the container shaking direction 940 to agitate the cannabis particulates to ensure the smaller pieces of cannabis 928 encounter and fall through the apertures 910. Of course, the container shaking direction 940 need not solely correspond to the horizontal plane; what is important is that the container is not vertically tilted to such an extent that the cannabis is able to exit the container 830 before the separation process is complete. Once the larger and smaller pieces of cannabis 826, 828 have been separated, the container is rotated or titled in the cannabis pouring direction 942 indicated by a block arrow in FIG. 9. The cannabis pouring direction 942 may be indicated to a user by a visual indicator on the top surface of the body, as described above in reference to FIG. 3.

Figure 10A:
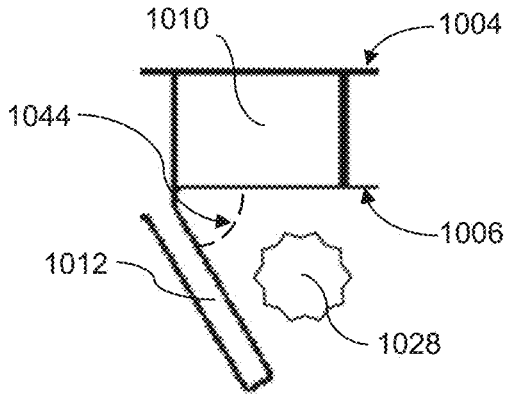
FIG. 10A shows a partial view of the cannabis particulate separator of FIG. 8, taken from the detail box B of FIG. 8, with cannabis particulate material.
Figure 10B:
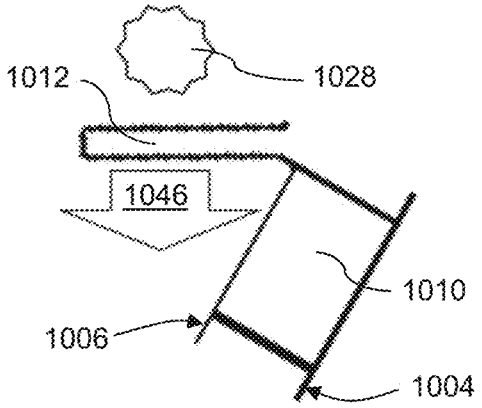
FIG. 10B shows the partial view of the cannabis particulate separator of FIG. 10A rotated in the container pouring direction of FIG. 9 into a first position.
Figure 10C:
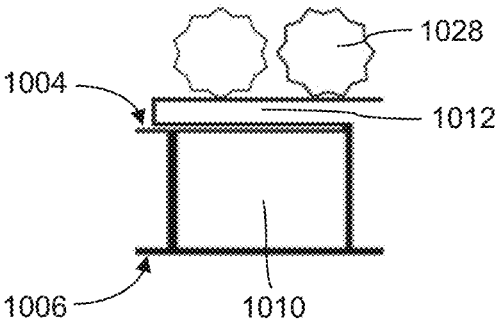
FIG. 10C shows the partial view of the cannabis particulate separator of FIG. 10A rotated in the container pouring direction of FIG. 9 into a second position.

FIGS. 10A through 10C show a detailed view of a cannabis particulate separator according to the present disclosure at various positions during use. In FIG. 10A, the separator is being or has been shaken to allow smaller pieces of cannabis 1028 to enter the aperture 1010 at the top surface 1004 of the body, fall through the aperture 1010, and exit the aperture 1010 at the bottom surface of the body 1006. As seen here, the flap 1012 is in its default position extending away from the bottom surface 1006 at an inclined angle 1044, although some displacement of the flap may occur due to shaking. In certain embodiments, the inclined angle 1044 at which the flaps extend away from the bottom surface of the body is between 60° and 70°. In FIG. 10B, the container with the separator positioned therein has been titled according to the cannabis pouring direction 942 of FIG. 9. The smaller pieces of cannabis 1026 fall via gravity from the bottom of the container back toward the separator. With the smaller pieces of cannabis 1026 contacting the flaps 1012 in the orientation provided by the container with the separator positioned therein being rotated in the cannabis pouring direction, the flaps are pressed in a closing direction 1046 toward the bottom surface 1006 and the aperture 1010 as indicated by a block arrow in FIG. 10B. At this point, the larger pieces of cannabis 1026 (not shown here) contained in the upper portion of the container above the top surface 1004 may have largely or completely exited the container via gravity. However, if the container with separator positioned therein were to be rotated or tilted in an opposite direction to the container pouring direction, then the smaller pieces of cannabis would be funneled through the apertures by the flaps and subsequently again mixed with the larger pieces of cannabis. As seen in FIG. 10C, if rotation is continued to the point where the container is fully inverted, the flaps 1012 close to cover the apertures 1010 in the manner of a valve, such that the smaller pieces of cannabis 1028 are prevented from exiting the bottom portion of the container by reentering the apertures 1010. Therefore, it should be appreciated that the diameter or width of the apertures 1010 is generally ≤the length the flaps 1012 in extending away from the bottom surface 1006 of the body, such that the flaps are configured to fully cover the apertures 1010 if pressed toward the bottom surface 1006 of the body by the smaller pieces of cannabis 1028. As discussed above with reference to FIG. 1, it should further be appreciated that at least the attachment of the flaps 1012 to the bottom surface 1006 comprises flexible or semi-flexible material, such that the flaps are able to bend in the closing direction 1046, and that material used has an elastic tendency to return to its default shape when the force of the smaller pieces of cannabis 1028 is removed for future uses. Of course, in some embodiments the entire flap 1012 or even the entire separator may comprise the same flexible or semi-flexible material (e.g. if the separator is injection molded as a single-piece construction).

Referring now to FIG. 11, a method 1100 of separating cannabis particulates by size using a cannabis particulate separator according to the present disclosure is shown. A first step 1102 comprises bending the supporting projection of the cannabis particulate separator at least 90° inward towards the bottom surface of the body of the cannabis particulate separator. A second step 1104 comprises inserting the cannabis particulate separator into a container such that the supporting projections are biased against an interior surface of the container by elastic forces. The cannabis particular separator is thereby held in place within the container by the elastic forces of the supporting projections and by frictional forces between the interior surface of the container and the supporting projections. The cannabis particulate separator may be inserted into the container until the bases of the supporting projections contact the bottom surface of the container, thereby providing vertical support to the body. In embodiments having one or more supporting columns integrally connected to and extending away from the bottom surface of the body, as discussed above in reference to FIG. 2, the cannabis particulate separator may be inserted into the container until the support column contacts the bottom surface of the container during the step of inserting the cannabis particulate separator into the container, such that the support column provides vertical support to the body in this manner. A third step 1106 comprises placing a desired amount of cannabis to be sorted onto the top surface of the body of the cannabis particulate separator positioned within the container. A fourth step 1108 comprises shaking the container with the cannabis particulate separator positioned therein to agitate the cannabis. Smaller pieces of cannabis having a diameter or width less than the diameter or width of the apertures enter the apertures at the top surface of the body, fall through the apertures to exit the apertures at the bottom surface of the body, and fall into a lower portion of the container enclosed by the body of the cannabis particulate separator (see also FIG. 9). On the other hand, larger pieces of cannabis having a diameter or width greater than the diameter or width of the apertures are unable to enter the apertures, and remain on the top surface of the body in an upper portion of the container. In this way, the cannabis particulates are separated by size according to the selectivity of the apertures in allowing passage therethrough. In should be appreciated that in this shaking step 1108, the container with the separator contained therein should not be titled to such an extent that cannabis exits the opening of the container or the smaller pieces are thrust back upwards through the apertures into the upper portion of the container, as may occur with a completely or substantially vertical shaking direction. After the cannabis particulates have been separated by size, a fifth step 1110 comprises rotating the container with the separator positioned therein in a pouring direction to remove the larger pieces of cannabis located in the upper portion of the container. The inclined angle at which the flaps extend away from the bottom surface of the body faces the pouring direction, such that the flaps prevent the smaller pieces of cannabis contained within the bottom portion of the container from reentering the apertures from the bottom surface of the body (see also FIGS. 10A-10C). If a user rotates the container in the pouring direction, the smaller pieces of cannabis located in the lower portion will first contract the flaps on their sides opposite the inclined angle, and the weight of the smaller pieces of cannabis will push the flaps toward the apertures and bottom surface of the body—the closing direction of the flaps. If the container is rotated through the pouring direction into a fully inverted position, then at that point, the flaps are closed over and cover the apertures by the weight of the smaller pieces of cannabis, such that the smaller pieces of cannabis are unable to exit the lower portion of the container through the apertures. Of course, the ability of the smaller pieces of cannabis to close the flaps depends on the amount of smaller pieces of cannabis present in the cannabis sample be processed, as well as the resistance of the flaps to shift under such force. While the amount of smaller pieces of cannabis is likely to be substantial in many applications such that separating the cannabis sample by particulate size is desirable, in other applications where the amount of smaller pieces of cannabis is less substantial and insufficient to physically displace the flaps, then the angling of the flaps in the pouring direction nonetheless prevents the smaller pieces of cannabis, or at least an appreciable quantity thereof, from entering back through the apertures and exiting the container with the larger pieces of cannabis. A six step 1112 comprises removing the cannabis particulate separator from the container. The body of the separator may be simply grasped and pulled out from the container, for example by a user pinching a surface and/or aperture with his or her fingers. Or, in embodiments having a gripping portion integrally connected to and projecting away from the top surface of the body, as discussed above in reference to FIG. 6, the cannabis particulate separator may alternatively be removed by a user grasping the gripping portion and pulling the cannabis particulate separator out from the container during the step of removing the separator from the container. At this point, the smaller pieces of cannabis remain in the container isolated by themselves, for further use as desired.

Figure 12:
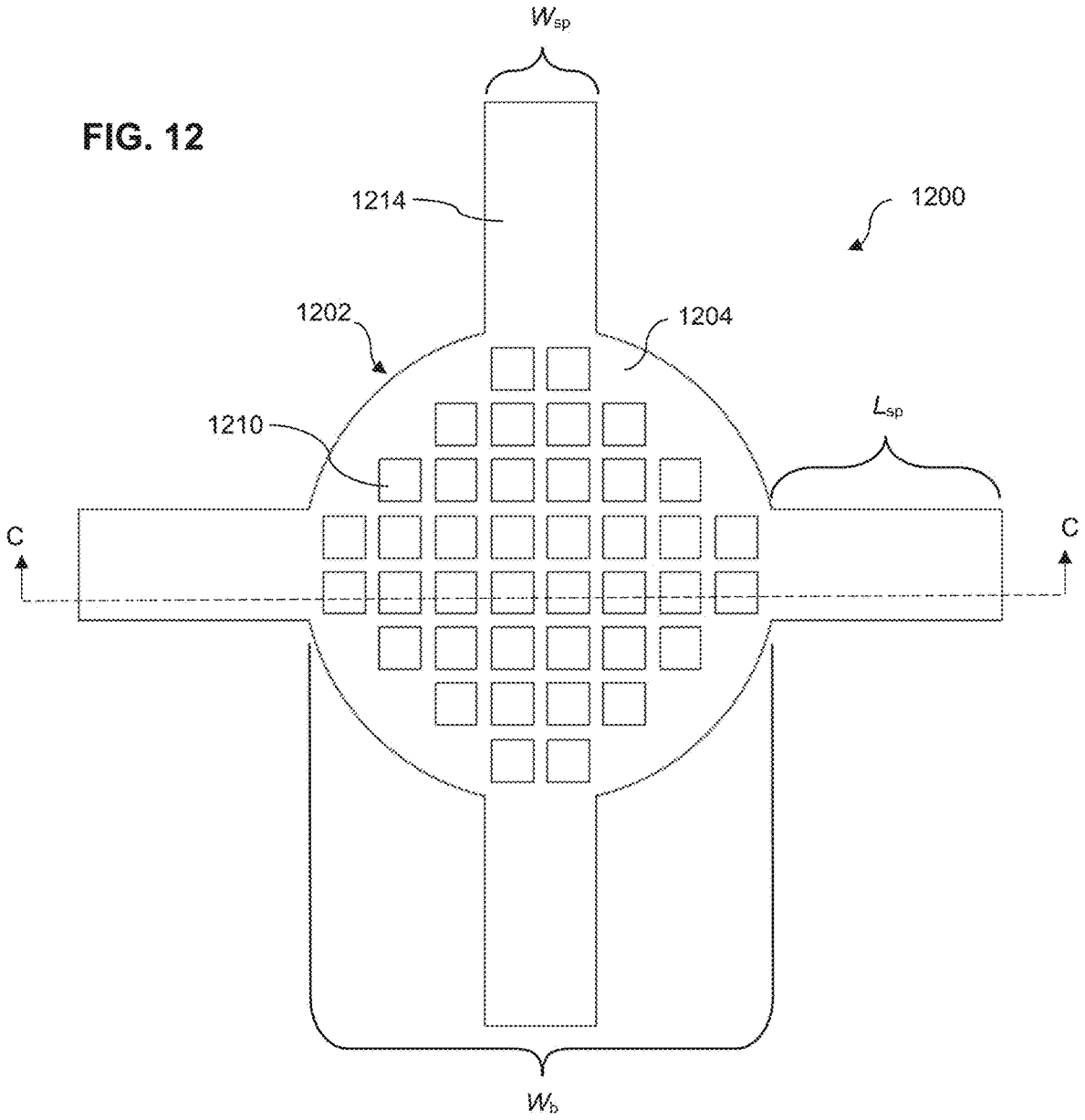
FIG. 12 shows a top view of another embodiment of a cannabis particulate separator according to the present disclosure.
Figure 13:
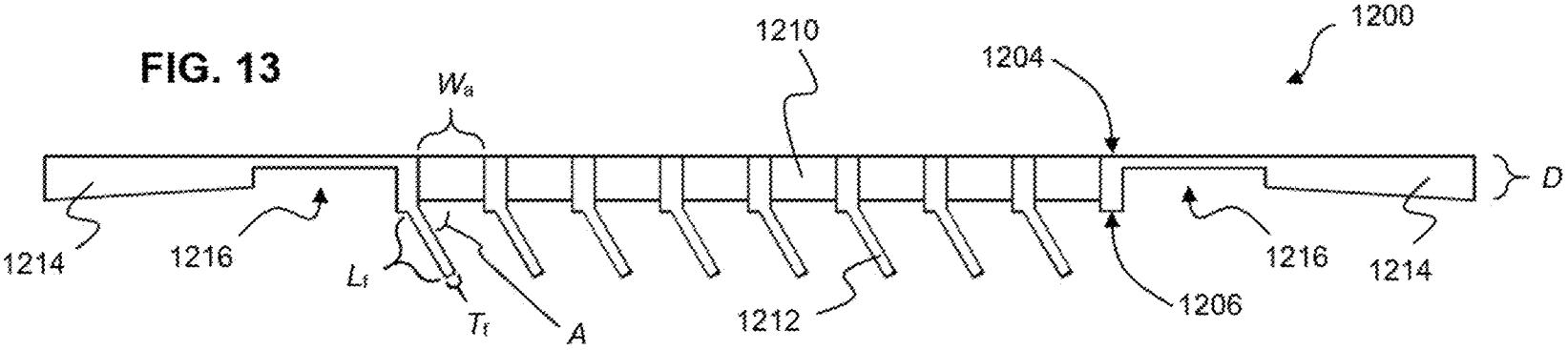
FIG. 13 shows a sectional view of the cannabis particulate separator of FIG. 12, taken along line C-C of FIG. 12.
Figure 14:
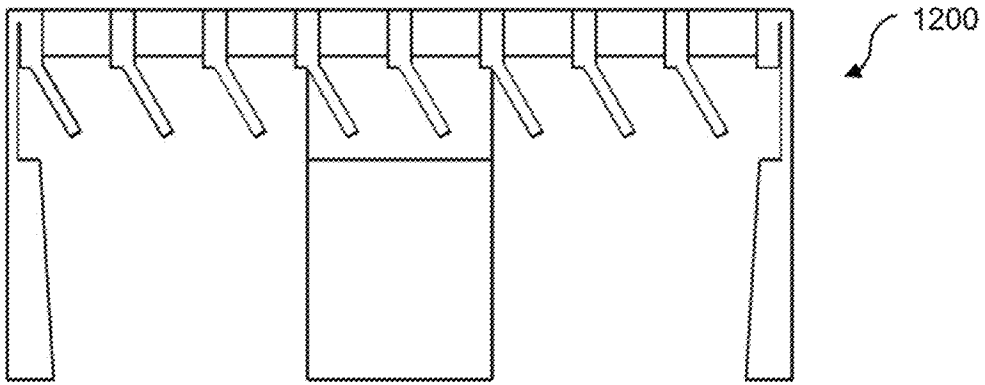
FIG. 14 shows the cannabis particulate separator of FIG. 13 with the supporting projections bent inward toward the bottom surface of the cannabis particulate separator.

As mentioned above, the size of a cannabis particulate separator according to the present disclosure is configured to substantially fit the container to be used with the cannabis particulate separator in practice, or vice versa. Likewise, the width or diameter of the apertures is determined by the desired size selectivity between the larger pieces of cannabis and the smaller pieces of cannabis to be separated from each other. For example, FIGS. 12-14 show an embodiment of a cannabis particulate separator 1200 designed for use with a cylindrical jar having a 4-in i.d. The body 1202 also a 4-in width or diameter $W_b$ in order to fill the internal volume cross sectional area of the jar when the separator 1200 is inserted therein. In the depicted embodiment, each of the supporting projections 1214 has a length $L_{sp}$ of approximately 2 in (5.08 cm) and a width $W_{sp}$ of approximately 1 in (2.54 cm), in projecting away from the body 1202. The length $L_{sp}$ of the supporting projections coincides with the height of the lower portion of the container when the separator 1200 is inserted in the jar. The depth D of the body 1202 and supporting projections 1214 is approximately 0.25 in (0.63 cm). The apertures 1210 have a width $W_a$ of approximately ⅜ in (0.96 cm). Of course, width $W_a$ may be increased or decreased according to the desired size selectivity of the apertures 1210. In some embodiments, the width $W_a$ may be decreased down through about ¼ in (0.63 cm) for example. The length $L_f$ of the flaps 1212 in extending away from the bottom surface 1206 of the body 1202 should be at least as great as the width $W_a$ of the apertures 1210, such that each flap 1212 is able to close its respective aperture 1210 when pressed toward the bottom surface 1206. In the depicted embodiment, then, each flap has a length $L_f$ of at least approximately ⅜ in (0.96 cm). In extending away from the bottom surface 1206, the flaps 1212 are inclined at an angle A of approximately 60° and have a thickness $T_f$ of about 1/16 in (0.16 cm). In some embodiments, the angle A may be increased up through about 70° for example. In the depicted embodiment of FIGS. 12-14, the longitudinal extent of the notches 1216 along the supporting projections 1214 has been increased relative to previously-described embodiments (see e.g. FIGS. 4-6). This may facilitate with bending the supporting projections 1216 inward towards the bottom surface 1206 of the body 1202 of the cannabis particulate separator 1200, before the separator 1200 is inserted into the jar during use.

It should be appreciated that the number and positional arrangement of the apertures along the body, and therefore the flaps, may be different depending on the embodiment. For example, a relatively larger cannabis particulate separator may have more apertures than a relatively smaller cannabis particulate separator, due to the increased available area along the top and bottom surfaces. Likewise, a cannabis particulate separator for use with a rectangular container may have a different positional arrangement of apertures than a cannabis particulate separator for use with a circular container, in effectively utilizing the available surface area. The number and arrangement of supporting projections may also vary in view of the container used.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general, the terms and phrases used herein have their art-recognized meaning, which can be found by reference to standard texts, journal references and contexts known to those skilled in the art. The above definitions are provided to clarify their specific use in the context of the invention.

LIST OF REFERENCE NUMERALS

X00 cannabis particulate separator
X02 body
X04 top surface of body
X06 bottom surface of body
X08 side surface of body
X10 apertures
X12 flaps
X14 supporting projections
X16 supporting projection notch
X18 supporting projection folding direction
X20 support column
X22 visual indicator
X24 gripping portion
X26 large pieces of cannabis
X28 small pieces of cannabis
X30 container
X32 container interior volume cross sectional area
X34 container interior surface
X36 container top portion
X38 container bottom portion
X40 container shaking direction
X42 container pouring direction
X44 flap incline angle
X46 flap closing direction
$W_b$ body width
$L_{sp}$ supporting projection length
$W_{sp}$ supporting projection depth
D body/supporting projection depth
$W_a$ aperture width
$L_f$ flap length
A flap angle
$T_f$ flap thickness

The invention claimed is:

1. A cannabis particulate separator for separating cannabis particulates by size, comprising:

a body having a top surface and a bottom surface;

a plurality of apertures which extend through the body between the top surface and the bottom surface;

a plurality of flaps integrally disposed on the bottom surface of the body, wherein the flaps extend away from the bottom surface of the body at an angle relative to the bottom surface, and each flap is connected to the bottom surface of the body adjacent to one of the apertures; and flexible supporting projections which extend away from the body, wherein the supporting projections are configured to bend inward toward the bottom surface.

2. The cannabis particulate separator of claim 1, further comprising a support column integrally connected to and extending away from the bottom surface of the body.

3. The cannabis particulate separator of claim 1, further comprising a gripping portion integrally connected to and projecting outward away from the top surface, wherein the gripping portion is configured to be grasped by a user.

4. The cannabis particulate separator of claim 1, wherein the cannabis particulate separator is formed of a flexible or semi-flexible material.

5. The cannabis particulate separator of claim 4, wherein the cannabis particulate separator is injection molded.

6. The cannabis particulate separator of claim 4, wherein the cannabis particulate separator is formed of silicone.

7. The cannabis particulate separator of claim 6, wherein the cannabis particulate separator is injection molded.

8. The cannabis particulate separator of claim 1, wherein the diameter of each aperture is ≤the length of each flap in extending away from the bottom surface of the body, such that the flaps are configured to cover the apertures if pressed toward the bottom surface of the body.

9. The cannabis particulate separator of claim 1, wherein the apertures are between approximately 0.63 cm to 0.96 cm in diameter.

10. The cannabis particular separator of claim 1, wherein the apertures are equal or substantially equal in diameter.

11. The cannabis particulate separator of claim 1, wherein the top surface of the body includes a visual indicator, and the visual indicator indicates a direction of the flaps in extending away from the bottom surface of the body at the angle.

12. The cannabis particulate separator of claim 11, wherein the visual indicator comprises color, text, or a symbol.

13. The cannabis particulate separator of claim 1, wherein the angle at which the flaps extend away from the bottom surface of the body is between 60° and 70°.

14. The cannabis particulate separator of claim 1, wherein the body further comprises a side surface extending between the top surface and the bottom surface of the body, and the supporting projections are connected to the body along the side surface.

15. The cannabis particulate separator of claim 1, wherein cannabis particulate separator has four supporting projections equally spaced around the body.

16. The cannabis particulate separator of claim 1, wherein each supporting projection has a notch extending into the supporting projection adjacent to the bottom surface of the body, the notch configured to allow the supporting projection to bend at least 90° inward toward the bottom surface of the body.

17. A method for separating cannabis particulates by size using the cannabis particulate separator of claim 1, comprising the steps of:

bending the supporting projections of the cannabis particulate separator at least 90° inward towards the bottom surface of the body of the cannabis particulate separator;

inserting the cannabis particulate separator into a container such that the supporting projections are biased against an interior surface of the container by elastic forces, whereby the cannabis particular separator is held in place within the container by the elastic forces of the supporting projections and by frictional forces between the interior surface of the container and the supporting projections;

placing cannabis onto the top surface of the body of the cannabis particulate separator positioned within the container;

shaking the container with the cannabis particulate separator positioned therein to agitate the cannabis, such that smaller pieces of cannabis having a diameter less than the diameter of the apertures enter the apertures at the top surface of the body, fall through the apertures to exit the apertures at the bottom surface of the body, and fall into a bottom portion of the container enclosed by the body of the cannabis particulate separator;

rotating the container with the cannabis particulate separator positioned therein in a pouring direction to remove larger pieces of cannabis having a diameter greater than the diameter of apertures on the top surface from the container, whereby the angle at which the flaps extend away from the bottom surface of the body faces the pouring direction, such that the flaps prevent the smaller pieces of cannabis contained within the bottom portion of the container from reentering the apertures from the bottom surface of the body; and removing the cannabis particulate separator from the container.

18. The method of claim 17, wherein the cannabis particulate separator comprises a support column integrally connected to and extending away from the bottom surface of the body, and the cannabis particulate separator is inserted into the container until the support column contacts a bottom surface of the container during the step of inserting the cannabis particulate separator into the container.

19. The method of claim 17, wherein the cannabis particulate separator comprises a gripping portion integrally connected to and projecting away from the top surface, and the cannabis particulate separator is removed by a user grasping the gripping portion and pulling the cannabis particulate separator out from the container during the step of removing the cannabis particulate separator from the container.

20. The method of claim 17, wherein the flaps are closed over the apertures by the weight of the smaller pieces of cannabis when the container is rotated in the pouring direction to remove the larger pieces of cannabis.

* * * * *